US012553113B2

(12) United States Patent
Ohno et al.

(10) Patent No.: US 12,553,113 B2
(45) Date of Patent: Feb. 17, 2026

(54) LOW THERMAL EXPANSION CAST STEEL AND METHOD OF PRODUCTION OF SAME

(71) Applicant: Shinhokoku Material Corp., Kawagoe (JP)

(72) Inventors: Haruyasu Ohno, Kawagoe (JP); Naoki Sakaguchi, Kawagoe (JP); Kotaro Ona, Kawagoe (JP)

(73) Assignee: SHINHOKOKU MATERIAL CORP., Kawagoe (JP)

( * ) Notice: Subject to any disclaimer, the term of this patent is extended or adjusted under 35 U.S.C. 154(b) by 459 days.

(21) Appl. No.: 17/800,488

(22) PCT Filed: Mar. 24, 2020

(86) PCT No.: PCT/JP2020/013125
§ 371 (c)(1),
(2) Date: Aug. 17, 2022

(87) PCT Pub. No.: WO2021/192060
PCT Pub. Date: Sep. 30, 2021

(65) Prior Publication Data
US 2023/0108470 A1 Apr. 6, 2023

(51) Int. Cl.

| | |
|---|---|
| ***C22C 38/10*** | (2006.01) |
| ***C21D 1/18*** | (2006.01) |
| ***C21D 6/00*** | (2006.01) |
| ***C22C 38/02*** | (2006.01) |
| ***C22C 38/04*** | (2006.01) |

(52) U.S. Cl.
CPC ..... *C22C 38/105* (2013.01); *C21D 1/18* (2013.01); *C21D 6/001* (2013.01); *C21D 6/005* (2013.01); *C21D 6/007* (2013.01); *C21D 6/008* (2013.01); *C22C 38/02* (2013.01); *C22C 38/04* (2013.01)

(58) Field of Classification Search
None
See application file for complete search history.

(56) References Cited

U.S. PATENT DOCUMENTS

| | | | |
|---|---|---|---|
| 2003/0118468 | A1 | 6/2003 | Li |
| 2019/0048433 | A1 | 2/2019 | Uehara et al. |

FOREIGN PATENT DOCUMENTS

| | | | | |
|---|---|---|---|---|
| CN | 105296844 | A | | 2/2016 |
| EP | 4 130 299 | A1 | | 2/2023 |
| JP | 62-167833 | A | | 7/1987 |
| JP | 1-306541 | A | | 12/1989 |
| JP | 3-166338 | A | | 7/1991 |
| JP | 6-172919 | A | | 6/1994 |
| JP | 8-257731 | A | | 10/1996 |
| JP | 11-279708 | A | | 10/1999 |
| JP | 11-279709 | A | | 10/1999 |
| JP | 11-293413 | A | | 10/1999 |
| JP | 2015-168865 | A | | 9/2015 |
| JP | 2016-27188 | A | | 2/2016 |
| JP | 2016027187 | A | * | 2/2016 |
| JP | 2018188690 | A | * | 11/2018 |
| JP | 2020-122180 | A | | 8/2020 |
| JP | 2020-122188 | A | | 8/2020 |
| WO | WO 2015/136766 | A1 | | 9/2015 |
| WO | WO 2017/056674 | A1 | | 4/2017 |

OTHER PUBLICATIONS

Martensitic transformation and 1nvar effect m Fe—Ni—Co alloys Materials Chemistry and Physics, JO ( 1 991) 115-119 (Year: 1991).*

International Search Report (Form PCT/ISA/210) for International Application No. PCT/JP2020/013125, dated Jun. 30, 2020.

Written Opinion of the International Searching Authority (Form PCT/ISA/237) for International Application No. PCT/JP2020/013125, dated Jun. 30, 2020, with an English translation.

* cited by examiner

*Primary Examiner* — Jenny R Wu
(74) *Attorney, Agent, or Firm* — Birch, Stewart, Kolasch & Birch, LLP

(57) ABSTRACT

An object of the present invention is to provide a low thermal expansion cast steel having sufficient strength even at a high temperature and a low coefficient of thermal expansion. The low thermal expansion cast steel of the present invention is obtained by suitably heat treating a cast steel comprising, by mass %, C: 0 to 0.10%, Si: 0 to 1.00%, Mn: 0 to 1.00%, Co: 13.00 to 17.50%, Ni satisfying $-3.5\times\%\ Ni+118\leq\%\ Co\leq-3.5\times\%\ Ni+121$ (% Ni and % Co respectively represent the contents of Ni and Co (mass %)), and a balance of Fe and unavoidable impurities so that the 0.2% proof stress in a tensile test at 400° C. becomes 100 MPa or more, the average coefficient of thermal expansion at 25 to 350° C. becomes 6.0 ppm/° C. or less, and the Curie temperature becomes 350° C. or more.

4 Claims, No Drawings

LOW THERMAL EXPANSION CAST STEEL AND METHOD OF PRODUCTION OF SAME

FIELD

The present invention relates to a low thermal expansion cast steel, more particularly relates to a low thermal expansion cast steel excellent in high temperature strength.

BACKGROUND

With the development of communications technologies in recent years, parabolic antennas and other such devices used in transmitting and receiving equipment have become extremely large in size. There has been demand for materials with low thermal expandability as well as high shaping precision, that is, castability, machinability, vibration absorption performance, mechanical strength, etc. For example, carbon fiber-reinforced plastic (CFRP), which has high rigidity and corrosion resistance, is generally used for antenna reflectors.

The coefficient of thermal expansion of CFRP is lower in comparison to steel. To secure high dimensional precision after shaping, it is necessary for the shaping die to be formed from material with the same extent of coefficient of thermal expansion. For this reason, an invar alloy or super invar alloy is selected as the material for the shaping die.

PTL 1 discloses using for a shaping die a low thermal expansion cast iron comprising cast iron having a graphite structure in austenite base iron, containing, as a chemical composition indicated by mass %, solid solution carbon in 0.09% or more and 0.43% or less, silicon in less than 1.0%, nickel in 29% or more and 34% or less, and cobalt in 4% or more and 8% or less, and a balance of iron, and having a coefficient of thermal expansion in a temperature range of 0 to 200° C. of $4\times10^{-6}$/° C. or less.

PTL 2 discloses using for a member for ultraprecision equipment including a CFRP alloy an alloy steel excellent in thermal shape stability and rigidity having a chemical composition containing C: 0.1 wt % or less, Si: 0.1 to 0.4 wt %, Mn: 0.15 to 0.4 wt %, Ti: more than 2 to 4 wt %, Al: 1 wt % or less, Ni: 30.7 to 43.0 wt %, Co: 14 wt % or less, having contents of Ni and Co satisfying formula (1) below, and comprising a balance of Fe and unavoidable impurities, and having a coefficient of thermal expansion in a temperature range of −40 to 100° C. of $4\times10^{-6}$/° C. or less and a Young's modulus of 16100 kgf/mm$^2$ or more.

$$37.7\leq Ni+0.8\times Co\leq 43 \quad (1)$$

CITATIONS LIST

Patent Literature

[PTL 1] Japanese Unexamined Patent Publication No. 6-172919

[PTL 2] Japanese Unexamined Patent Publication No. 11-293413

SUMMARY

Technical Problem

Invar alloys and super invar alloys used in conventional CFRP shaping dies are low in strength at a high temperature in the region of the usage temperature of the dies, so there is the technical problem that such dies are easily damaged.

The present invention has as its object, in consideration of the above situation, the provision of a low thermal expansion cast steel having sufficient strength even in the region of the usage temperature of a CFRP die of 400° C. and having a low coefficient of thermal expansion in the range of 25 to 400° C.

Solution to Problem

The inventors intensively studied methods for increasing the proof stress of low thermal expansion cast steels at high temperatures. As a result, they discovered that by controlling the contents of Ni and Co in a Fe—Ni—Co alloy to suitable ranges and further applying suitable heat treatment after casting, it is possible to increase the proof stress at high temperatures without having to use Nb, Ti, Al, and other expensive alloy elements.

The present invention was made based on this finding and has as its gist the following.

(1) A low thermal expansion cast steel characterized by having a chemical composition containing, by mass %, C: 0 to 0.10%, Si: 0 to 1.00%, Mn: 0 to 1.00%, Co: 13.00 to 17.50%, Ni satisfying −3.5×% Ni+118≤% Co≤−3.5×% Ni+121 (% Ni and % Co respectively representing the contents of Ni and Co (mass %)), and a balance of Fe and unavoidable impurities and having a 0.2% proof stress in a tensile test at 400° C. of 100 MPa or more, an average coefficient of thermal expansion at 25 to 350° C. of 6.0 ppm/° C. or less, and a Curie temperature of 350° C. or more.

(2) A method for producing a low thermal expansion cast steel characterized by comprising, in order, a cryogenic treatment step of cooling a cast steel having a chemical composition of (1) from room temperature to the Ms point or below, holding it at a temperature of the Ms point or less for 0.5 to 3 hours, and raising it to room temperature and a recrystallization step of heating the cast steel to 800 to 1200° C., holding it for 0.5 to 5 hours, then quenching.

(3) A method for producing a low thermal expansion cast steel characterized by comprising, in order, a first cryogenic treatment step of cooling a cast steel having a chemical composition of (1) from room temperature to the Ms point or below, holding it at a temperature of the Ms point or less for 0.5 to 3 hours, and raising it to room temperature and a recrystallization step of heating the cast steel to 800 to 1200° C., holding it for 0.5 to 5 hours, then quenching, a second cryogenic treatment step of cooling the cast steel from room temperature to the Ms point or less, holding it at a temperature of the Ms point or less for 0.5 to 3 hours, and raising it to room temperature, and a reverse transformation step of heating the cast steel to 600 to 750° C., holding it for 0.5 to 5 hours, and then quenching.

(4) A method for producing a low thermal expansion cast steel characterized by comprising, in order, a cryogenic treatment step of cooling a cast steel having a chemical composition of (1) from room temperature to the Ms point or below, holding it at a temperature of the Ms point or less for 0.5 to 3 hours, and raising it to room temperature and a reverse transformation step of heating the cast steel to 600 to 750° C., holding it for 0.5 to 5 hours, and then quenching.

Advantageous Effects of the Invention

According to the present invention, a low thermal expansion cast steel having a high proof stress at the high temperature region and also a low coefficient of thermal expansion can be obtained and therefore can be applied to ultraprecision equipment such as a CFRP die used under high temperature.

DESCRIPTION OF EMBODIMENTS

Below, the present invention will be explained in detail. Below, percentages relating to the chemical composition are expressed as mass % unless otherwise noted. First, the chemical composition of the cast steel of the present invention will be explained.

In the present invention, Ni and Co are elements which are essential for contributing to reducing the coefficient of thermal expansion by being added in combination. In particular, in the present invention, Co is included in a fixed amount or more to make the Curie temperature 350° C. or more, and an approximate amount of Ni corresponding to the amount of Co is further included to make the coefficient of thermal expansion sufficiently smaller over a wide temperature range. If the amounts of Ni and Co are too great, the Ms point becomes too low and it becomes difficult to cause a martensitic transformation through cooling, which will be explained later, so the amount of Ni and the amount of Co are determined considering this as well.

To make the Curie temperature 350° C. or more and further make the coefficient of thermal expansion sufficiently smaller over a wide temperature range, the content of Co is made 13.00 to 17.50% and the Ni content is made a range satisfying $-3.5\times\%\ Ni+118\leq\%\ Co\leq-3.5\times\%\ Ni+121$, where the Co content is % Co (mass %) and the Ni content is % Ni (mass %).

The Curie temperature is made 350° C. or greater in order to achieve a low coefficient of thermal expansion at high temperatures. There is an intimate relationship between the Curie temperature and coefficient of thermal expansion, and invar alloys will have a coefficient of thermal expansion close to 0 at temperatures less than or equal to the Curie temperature and a rapidly increasing coefficient of thermal expansion at temperatures over the Curie temperature. The low expansion cast steel of the present invention assumes use around 400° C., the in-use temperature range of a CFRP die, and in order to make the coefficient of thermal expansion in this temperature range low, the Curie temperature is made 350° C. or greater.

C forms a solid solution in austenite and contributes to an increase in strength, therefore may be included as necessary. This effect can be achieved even with a small amount, so an amount of C of 0.010% or more is effective and preferable. However, if the content of C becomes larger, the coefficient of thermal expansion becomes larger and further the ductility falls, making casting cracks more likely to occur, so the content is made 0.10% or less, preferably 0.050% or less, more preferably 0.020% or less. In the low thermal expansion cast steel of the present invention, C is not an essential element, and the content may be 0.

Si may be added as a deoxidant. Further, it is possible to improve the fluidity of the molten metal. This effect can be obtained even with a small amount, so making the amount of Si 0.05% or more is effective and preferable. If the amount of Si is over 1.00%, the coefficient of thermal expansion will increase, so the amount of Si is made 1.00% or less, preferably 0.50% or less, more preferably 0.20% or less. In the low thermal expansion cast steel of the present invention, Si is not an essential element, and the content may be 0.

Mn may be added as a deoxidant. Further, it also contributes to improvement in strength by solution strengthening. This effect can be obtained even with a small amount, so making the amount of Mn 0.10% or more is effective and preferable. Even if the content of Mn is over 1.00%, the effect becomes saturated and the cost increases, so the amount of Mn is made 1.00% or less, more preferably 0.50% or less. In the low thermal expansion cast steel of the present invention, Mn is not an essential element, and the content may be 0.

The balance in the chemical composition is Fe and unavoidable impurities. Unavoidable impurities mean constituents that enter unavoidably from raw materials, the production environment, etc., when industrially producing steel having the chemical composition prescribed in the present invention. Specifically, 0.02% or less of P, S, O, N, etc. may be mentioned.

Next, the method of producing the low thermal expansion cast steel of the present invention will be explained.

First, a cast steel comprising the desired chemical composition is produced by casting. The casting mold used in casting and the apparatus and method for injecting molten steel into the casting mold are not particularly limited. Well-known apparatuses and methods may be used.

Any of the following heat treatments are applied to the acquired cast steel.

[1] First cryogenic treatment step→recrystallization step

[2] First cryogenic treatment step→recrystallization step→second cryogenic treatment step→reverse transformation step

[3] First cryogenic treatment step→reverse transformation step

Each of these steps will be explained.

First Cryogenic Treatment Step

The cast steel is cooled to the Ms point or less, held at a temperature of the Ms point or less for 0.5 to 3 hours, and then raised to room temperature. The method of cooling is not particularly limited. Note that, the Ms point referred to here is the Ms point at a stage before the effect of the present invention is manifested. It is enough that the cooling temperature be made sufficiently below the Ms point, so there is no need for the exact Ms point to be known at this stage. Generally, the Ms point can be estimated with the following formula using the constituents of the steel.

$$Ms=521-353C-22Si-24.3Mn-7.7Cu-17.3Ni-17.7Cr-25.8Mo$$

Here, C, Si, Mn, Cu, Ni, Cr, and Mo represent the contents (mass %) of the elements. Elements not included are indicated as 0.

In the case of the chemical composition of the low thermal expansion cast steel of the present invention, the Ms point calculated with the above formula is in particular dependent on the amount of Ni and will be from room temperature to −100° C. or less, therefore dry ice, methyl alcohol, or ethyl alcohol can be used as a cooling medium for up to −80° C. Further, a method of immersing the cast steel in liquid nitrogen or a method of spraying liquid nitrogen can be used at low temperatures of up to −196° C. Due to this, a structure containing martensite is formed. Further, the temperature can be increased by raising the cast steel up in an atmosphere at room temperature.

Recrystallization Step

The cast steel is reheated to 800 to 1200° C., held at 800 to 1200° C. for 0.5 to 5 hours, and quenched to room temperature. This returns the structure in which martensite is formed to an austenitic structure. The grain size of the structure formed by normal solidification is about 1 to 10 mm, but by going through the above cryogenic treatment step and the subsequent recrystallization step, the austenite grain size becomes finer and the structure becomes a mainly equiaxed grain with a random crystal orientation. The structure after quenching becomes a fine equiaxed grain with an average grain size of about 30 to 800 μm. This makes it possible to increase the Young's modulus and also to achieve a high 0.2% proof stress at 400° C. The quenching method is not particularly limited, but water cooling is preferable.

Second Cryogenic Treatment Step

Following recrystallization, the cast steel is once again cooled to the Ms point or less, held at a temperature of the Ms point or less for 0.5 to 3 hours, then raised to room temperature. The cooling and increase in temperature in the second cryogenic treatment step can be performed in a similar manner to those in the first cryogenic treatment step. Through these treatments, the structure of the cast steel once again becomes a structure including martensite.

Reverse Transformation Step

Following the cryogenic treatment, the cast steel is heated to 600 to 750° C., held for 0.5 to 5 hours, and then quenched to room temperature to make the structure austenitic. Plastic deformation occurs when the structure undergoes the martensitic transformation in the cryogenic treatment step. The strain (dislocations) at this time remains in the structure having become austenitic from the reverse transformation. This makes it possible to achieve a high 0.2% proof stress at 400° C.

The martensitic structure returns to being austenitic when heated to 600° C. or more, but the austenite will recrystallize from the driving force from the dislocations at a heating temperature of over 750° C.; therefore the heating temperature is made 750° C. or less. Note that, the size of the austenite grains does not change due to cryogenic treatment step and the reverse transformation step following it.

As explained above, the sequence of the cryogenic treatment step to the recrystallization step makes it possible to achieve a high Young's modulus and a high 0.2% proof stress at 400° C., while the sequence of the cryogenic treatment step to the reverse transformation step makes it possible to achieve a higher 0.2% proof stress at 400° C.; therefore steps [1] to [3] may be selected according to the necessary properties.

Before the first cryogenic treatment step, a solutionizing step may be provided in which the cast steel is heated to 800 to 1200° C., held for 0.5 to 5 hours, and quenched to room temperature. Through solutionization, precipitates formed during casting dissolve, improving ductility and toughness. The quenching method is not particularly limited, but water cooling is preferable.

Solidification nuclei may be easily formed by including Nb, Ti, B, Mg, Ce, and La as inoculants to the melt at the time of the production of the cast steel. Further, solidification nuclei may be easily formed by coating inoculants such as $Co(AlO_2)$, $CoSiO_3$, and Co-borate on the surface of the casting mold together with the coating material that is normally coated on a casting mold. Further, the melt in the casting mold may be stirred and made to flow by employing a method using an electromagnetic stirring apparatus, a method of mechanically making the casting mold vibrate, a method of making the melt vibrate by ultrasonic waves, etc. By applying these methods, the structure of the cast steel becomes more easily equiaxed, so the low thermal expansion cast steel of the present invention can be more efficiently produced. The excellent high temperature strength of the low thermal expansion cast steel of the present invention can be evaluated from the results of a tensile test at 400° C. Specifically, the low thermal expansion cast steel of the present invention has the property of the 0.2% proof stress measured in a tensile test at 400° C. being 100 MPa or more.

The low thermal expansion cast steel of the present invention can further achieve an average coefficient of thermal expansion at 25 to 400° C. of 6.0 ppm/° C. or less and a low coefficient of thermal expansion over a wide temperature range. By adjusting the average coefficient of thermal expansion to 4.0 to 6.0 ppm, it will match the coefficient of thermal expansion of CFRP, making the cast steel preferable as a member of a CFRP shaping die.

Since the low thermal expansion cast steel of the present invention has a high Curie temperature, the coefficient of thermal expansion will not greatly increase at even high temperature, and since it has a high high-temperature proof stress, damage can be minimized even when used in a member for ultraprecision equipment used at high temperature such as a CFRP die.

EXAMPLES

Melts adjusted to have the chemical composition shown in Table 1 using a high-frequency induction furnace were poured into casting molds to produce Y blocks. Afterwards, the heat treatments shown below were applied.

Treatment No. 1:

First cryogenic treatment step→recrystallization step

Treatment No. 2:

First cryogenic treatment step→recrystallization step→second cryogenic treatment step→reverse transformation step Treatment No. 3:

First cryogenic treatment step→reverse transformation step

Treatment No. 0:

No heat treatment

In the first cryogenic treatment step, each Y block was immersed in liquid nitrogen, cooled to the Ms point or below, then held for 1.5 hours, then taken out from the liquid nitrogen and left at room temperature so as to rise to room temperature.

In the recrystallization step, the Y block was heated to the temperature described in Table 1, held for 3 hours, then subjected to water cooling.

In the second cryogenic treatment step, a similar treatment to the first cryogenic treatment step was applied.

In the reverse transformation step, the Y block was heated to the temperature described in Table 1, held for 3 hours, and then subjected to water cooling.

Two samples were taken from the acquired cast steel, the samples were tested by a tensile test (based on JIS G 0567) at 400° C., the 0.2% proof stress was measured using the offset method, and the average of the two samples was made the measurement value. Similarly, test pieces for measuring the coefficient of thermal expansion were taken, and the average coefficient of thermal expansion at 25 to 400° C. and the Curie temperature were measured. For the Curie temperature, the inflection point found from a chart of the elongation-temperature at the time of measurement was used.

The results are shown in Table 1.

The low thermal expansion cast steel of the present invention has a low coefficient of thermal expansion and demonstrated a high 0.2% proof stress in a tensile test at 400° C.

In contrast, the comparative examples did not achieve the target properties in at least one of 0.2% proof stress at 400° C. and the coefficient of thermal expansion.

TABLE 1

| | Alloy | Chemical constituents (mass %), balance Fe and unavoidable impurities | | | | | Treatment | Heat treatment | |
|---|---|---|---|---|---|---|---|---|---|
| | | | | | | | | First cryogenic | Recrystallization |
| | No. | C | Si | Mn | Ni | Co | no. | (° C.) | (° C.) |
| Example 1 | 1 | 0.017 | 0.11 | 0.58 | 30.01 | 14.69 | 1 | Yes | 830 |
| Example 2 | 1 | 0.017 | 0.11 | 0.58 | 30.01 | 14.69 | 2 | Yes | 830 |
| Example 3 | 1 | 0.017 | 0.11 | 0.58 | 30.01 | 14.69 | 2 | Yes | 950 |
| Example 4 | 1 | 0.017 | 0.11 | 0.58 | 30.01 | 14.69 | 2 | Yes | 1200 |
| Example 5 | 1 | 0.017 | 0.11 | 0.58 | 30.01 | 14.69 | 3 | Yes | — |
| Example 6 | 2 | 0 | 0.52 | 0.46 | 29.91 | 14.95 | 3 | Yes | — |
| Example 7 | 3 | 0.025 | 0.43 | 0.47 | 29.47 | 15.66 | 2 | Yes | 1000 |
| Example 8 | 4 | 0.011 | 0 | 0.63 | 29.88 | 16.01 | 2 | Yes | 950 |
| Example 9 | 5 | 0.013 | 0.85 | 0.52 | 30.04 | 13.32 | 1 | Yes | 900 |
| Example 10 | 6 | 0.018 | 0.33 | 0 | 29.46 | 17.03 | 2 | Yes | 850 |
| Example 11 | 7 | 0.008 | 0.47 | 0.82 | 30.33 | 13.86 | 3 | Yes | — |
| Example 12 | 8 | 0.016 | 0.19 | 0.61 | 30.68 | 13.25 | 1 | Yes | 1100 |
| Example 13 | 9 | 0.015 | 0.26 | 0.60 | 28.84 | 17.40 | 2 | Yes | 900 |
| Comparative Example 1 | 1 | 0.017 | 0.11 | 0.58 | 30.01 | 14.69 | 2 | Yes | 1300 |
| Comparative Example 2 | 1 | 0.017 | 0.11 | 0.58 | 30.01 | 14.69 | 2 | Yes | 900 |
| Comparative Example 3 | 1 | 0.017 | 0.11 | 0.58 | 30.01 | 14.69 | 2 | Yes | 850 |
| Comparative Example 4 | 1 | 0.017 | 0.11 | 0.58 | 30.01 | 14.69 | 0 | — | — |
| Comparative Example 5 | 10 | 0.018 | 1.12 | 0.51 | 29.71 | 15.50 | 2 | Yes | 1050 |
| Comparative Example 6 | 11 | 0.012 | 0.22 | 1.09 | 29.88 | 14.98 | 3 | Yes | — |
| Comparative Example 7 | 12 | 0.017 | 0.18 | 0.53 | 30.81 | 14.33 | 2 | Yes | 950 |
| Comparative Example 8 | 13 | 0.015 | 0.09 | 0.58 | 29.16 | 14.75 | 1 | Yes | 900 |
| Comparative Example 9 | 14 | 0.021 | 0.40 | 0.22 | 29.96 | 12.22 | 1 | Yes | 850 |
| Comparative Example 10 | 15 | 0.014 | 0.54 | 0.52 | 29.13 | 17.96 | 2 | Yes | 1050 |

| | Heat treatment | | | | |
|---|---|---|---|---|---|
| | Second cryogenic treatment | Reverse transformation (° C.) | Curie temperature (° C.) | Coefficient of thermal expansion α25-350° C. (ppm/° C.) | 0.2% proof stress (Mpa) |
| Example 1 | — | — | 394 | 4.1 | 105 |
| Example 2 | Yes | 700 | 392 | 4.4 | 130 |
| Example 3 | Yes | 700 | 390 | 4.2 | 128 |
| Example 4 | Yes | 700 | 389 | 4.3 | 112 |
| Example 5 | — | 700 | 392 | 4.3 | 125 |
| Example 6 | — | 700 | 383 | 4.1 | 124 |
| Example 7 | Yes | 650 | 392 | 4.9 | 105 |
| Example 8 | Yes | 650 | 416 | 4.5 | 116 |
| Example 9 | — | — | 359 | 4.6 | 114 |
| Example 10 | Yes | 650 | 421 | 5.1 | 127 |
| Example 11 | — | 770 | 371 | 3.7 | 131 |
| Example 12 | — | — | 381 | 3.5 | 107 |
| Example 13 | Yes | 650 | 412 | 4.8 | 116 |
| Comparative Example 1 | Yes | 700 | 394 | 4.1 | 85 |
| Comparative Example 2 | Yes | 500 | 396 | 6.5 | 124 |
| Comparative Example 3 | Yes | 400 | 395 | 7.0 | 140 |
| Comparative Example 4 | — | — | 391 | 4.2 | 67 |
| Comparative Example 5 | Yes | 650 | 365 | 6.4 | 117 |
| Comparative Example 6 | — | 700 | 386 | 6.8 | 128 |
| Comparative Example 7 | Yes | 650 | 400 | 4.2 | 72 |
| Comparative Example 8 | — | — | 386 | 7.2 | 108 |
| Comparative Example 9 | — | — | 335 | 6.1 | 112 |
| Comparative Example 10 | Yes | 650 | 413 | 6.2 | 116 |

The invention claimed is:

1. A cast steel characterized by having a chemical composition consisting of, by mass %, C: 0.010 to 0.10%, Si: 0 to 1.00%, Mn: 0 to 1.00%, Co: 13.00 to 17.50%, Ni satisfying $-3.5\times\%\ Ni+118\leq\%\ Co\leq-3.5\times\%\ Ni+121$ (% Ni and % Co respectively representing the contents of Ni and Co (mass %)), and a balance of Fe and unavoidable impurities and having a 0.2% proof stress in a tensile test at 400° C. of 100 MPa or more, an average coefficient of thermal expansion at 25 to 350° C. of 6.0 ppm/° C. or less, and a Curie temperature of 350° C. or more.

2. A method for producing the cast steel of claim 1 characterized by comprising, in order, a cryogenic treatment step of cooling a cast steel having a chemical composition of claim 1 from room temperature to the Ms point or below, holding the cast steel at a temperature of the Ms point or less for 0.5 to 3 hours, and raising the cast steel to room temperature and a recrystallization step of heating the cast steel to 800 to 1200° C., holding the cast steel for 0.5 to 5 hours, then quenching;

thereby producing the cast steel of claim 1.

3. A method for producing the cast steel of claim 1 characterized by comprising, in order, a first cryogenic treatment step of cooling a cast steel having a chemical composition of claim 1 from room temperature to the Ms point or below, holding the cast steel at a temperature of the Ms point or less for 0.5 to 3 hours, and raising the cast steel to room temperature and a recrystallization step of heating the cast steel to 800 to 1200° C., holding the cast steel for 0.5 to 5 hours, then quenching, a second cryogenic treatment step of cooling the cast steel from room temperature to the Ms point or less, holding the cast steel at a temperature of the Ms point or less for 0.5 to 3 hours, and raising the cast steel to room temperature, and a reverse transformation step of heating the cast steel to 600 to 750° C., holding the cast steel for 0.5 to 5 hours, and then quenching;

thereby producing the cast steel of claim 1.

4. A method for producing the cast steel of claim 1 characterized by comprising, in order, a cryogenic treatment step of cooling a cast steel having a chemical composition of claim 1 from room temperature to the Ms point or below, holding the cast steel at a temperature of the Ms point or less for 0.5 to 3 hours, and raising the cast steel to room temperature and a reverse transformation step of heating the cast steel to 600 to 750° C., holding the cast steel for 0.5 to 5 hours, and then quenching;

thereby producing the cast steel of claim 1.

* * * * *